United States Patent [19]

Beall, III et al.

[11] 4,056,678

[45] Nov. 1, 1977

[54] ELECTRIC HEATING FURNACE

[75] Inventors: Benjamin S. Beall, III, Lake Forest; Russell F. Novy, Northbrook, both of Ill.

[73] Assignee: Sola Basic Industries, Inc., Milwaukee, Wis.

[21] Appl. No.: 659,676

[22] Filed: Feb. 20, 1976

[51] Int. Cl.[2] ..... H05B 3/06

[52] U.S. Cl. ..... 13/25

[58] Field of Search ..... 13/20, 22, 25; 219/390

[56] References Cited

U.S. PATENT DOCUMENTS

| | | | |
|---|---|---|---|
| 2,896,004 | 7/1959 | Duffy et al. | 13/22 |
| 3,456,935 | 7/1969 | Bornor | 219/390 |

*Primary Examiner*—R. N. Envall, Jr.

*Attorney, Agent, or Firm*—Parmelee, Johnson & Bollinger

[57] ABSTRACT

An electric heating furnace which includes a conductive electric resistance heating element strip mounted within a chamber defined by walls of porous refractory insulating material. Terminal or mounting pins extend through the wall of insulating material and the heating strip are secured thereby. A sleeve of non-porous refractory material surrounds the portion of the pin within the wall of insulating material for electrically insulating the pin from the porous refractory wall material which may have a conductive layer of carbon build up therein under certain heat treating conditions.

5 Claims, 4 Drawing Figures

FIG. 1
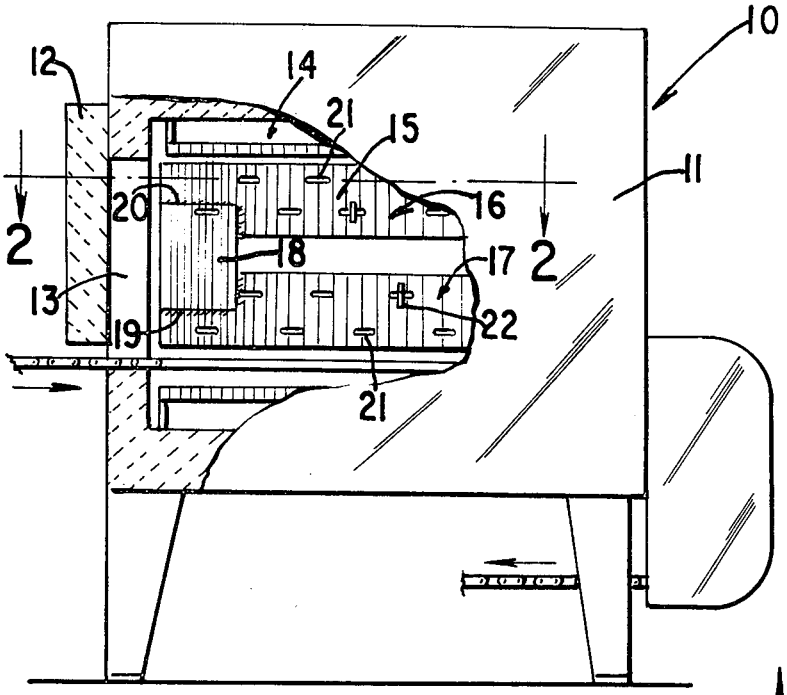
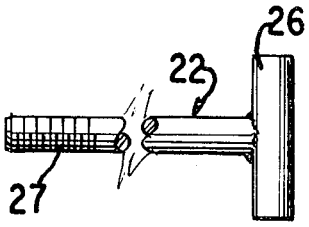
FIG. 3
FIG. 4
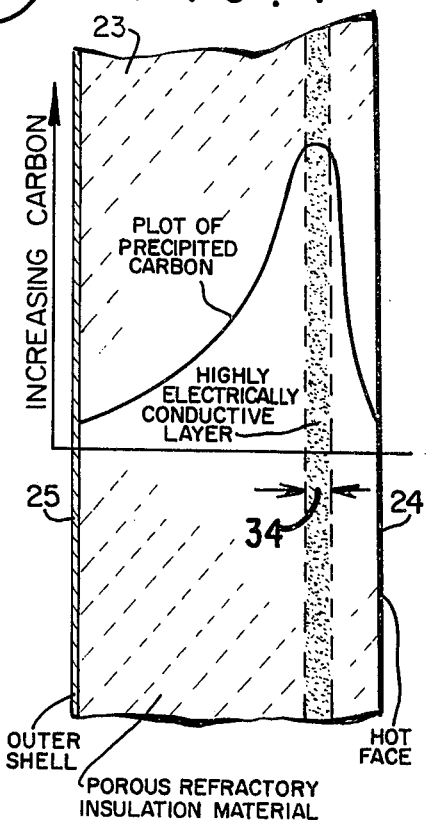
FIG. 2
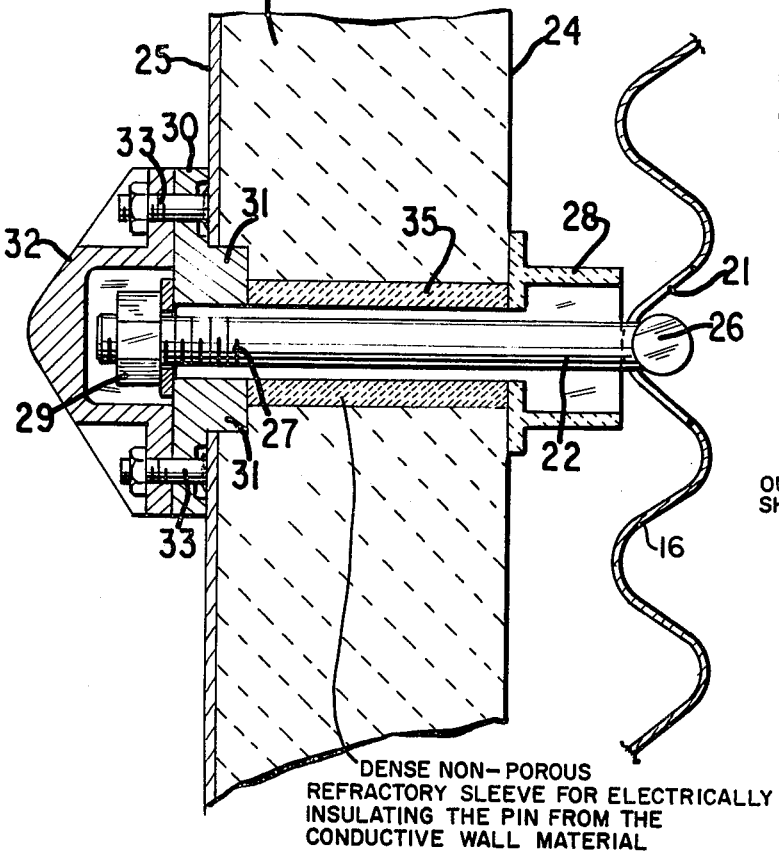

ELECTRIC HEATING FURNACE

The present invention relates to an electric heating furnace and, more particularly, to the structure of a mounting or terminal pin passing through the wall of the furnace for supporting an electric heating resistance strip therein.

Electric heating furnaces generally comprise a body having walls of insulating material which form a chamber therein to receive the material to be heated. Various types of strip resistance heating elements which are known in the art are then mounted within the chamber. The mounting structure may comprise a pin passing through the wall of insulating material with the inner end of the pin connected to the strip and the outer end connected to the shell of the body. Also, a terminal pin may pass through the wall of the chamber to be securely connected to the strip. Examples of such heating elements are seen in U.S. Pat. Nos. 2,820,076; 2,891,303; and 2,896,004.

It has been found in operation that under certain heat treating conditions a conductive layer of carbon may form within the insulating refractory wall which is spaced inwardly from the inner face of the wall. If a long enough "burnout" is not used, this layer will build up so as to become highly conductive. As a result, this conductive layer enables electricity to pass through the wall of insulating material and to contact the mounting or terminal pins passing therethrough. The electricity acting upon these pins brings about a rapid deterioration of the pins. "Burnout" is accomplished by passing a gaseous mixture including air under controlled flow conditions through the furnace at an incandescent temperature to chemically react out the carbon deposition; $C + O_2 = CO_2$.

One of the objects of the invention is to provide an improved mounting arrangement for the resistance heating element of an electric heating furnace.

Another object of the invention is to prevent deterioration of mounting or terminal pins passing through the wall of the chamber of an electric heating furnace.

Another of the objects is to prevent any adverse effects from a highly conductive layer of carbon which may build up within the chamber wall of insulating material.

According to one aspect of the present invention, an electric heating furnace has walls of insulating material defining a chamber therein to receive material to be heated and treated. A conductive electric heating resistance strip is within the chamber and pin means extend through a wall of the chamber to be connected to the resistance strip. A sleeve of refractory material surrounds the portion of the pin means within the chamber wall.

Other objects, advantages and features of the present invention will become apparent from the accompanying description and drawings, which are merely exemplary.

In the drawings:

FIG. 1 is a side elevational view of an electric heating furnace in which the present invention is incorporated with a portion of the furnace wall being cut away;

FIG. 2 is a sectional view in enlarged scale taken along the line 2—2 of FIG. 1 and illustrating in detail the present invention;

FIG. 3 is a broken plan view of a T-pin used in mounting the strip shown in FIG. 2; and FIG. 4 is a schematic diagram of a vertical section through an insulating wall of the chamber illustrating the conductivity in the region of a built-up conductive layer of carbon.

Proceeding next to the drawings wherein like reference symbols indicate the same parts throughout the various views, a specific embodiment of the present invention will be described in detail.

One type of furnace to which the invention can be applied is indicated generally at 10 (FIG. 1), it being understood that various types of heating elements can be used in such electric furnaces. The electric heating furnace comprises a body 11 having a slidably door 12 closing a front opening 13 of the furnace. Within the body there is defined a chamber 14 which is enclosed by rear, side, bottom and top walls made of a suitable refractory material which is generally porous.

The furnace chamber is heated by an electric resistance heating element 15 which may be of any suitable shape and in the present embodiment comprises spaced elongated heating strips 16 and 17 which are corrugated and held in spaced relation by a mating corrugated jumper strip 18. The corrugations are transverse of the longitudinal axis of a strip. In the form shown, the jumper strip or connector is welded at 19 and 20 to the strips 16 and 17 respectively but the strip may also comprise a single integral element formed to the appropriate shape. By using a welded jumper strip, having corrugations mating or complementary to those of the spaced longitudinal strips, an improved well bonded strip arrangement is obtained. Also, it is relatively simple to join the strips at the spaced distance desired and without waste of material, in contrast to where the corrugated strip is integral with spaced strips. The heating strip of the foregoing description is the subject matter of copending application Ser. No. 627,369, filed Oct. 30, 1975.

An increased radiating surface is provided at the charge end of the furnace. The jumper strip or connector is of the same material as the strips and, thus, will expand in the same relation. The connector also preferably is of the same cross section as the element sheet.

The spaced resistance strips and parts can be made of a suitable electrical resistance metal. A metal, such as "Inconel 601," a trademark of the International Nickel Company, Inc., can be used.

As known in the art, the spaced strips 16 and 17 are provided with a plurality of elongated apertures or slots 21 for receiving support rods 22 (FIG. 2) passing through a side wall of the furnace 23. The side wall 23 has an inner or hot face 24 adjacent to which is mounted the heating element and an outer shell 25.

The support rod 22 is in the form of a T-pin as shown in FIG. 3, having a T-head 26 and a threaded shank 27. The head 26 is inserted through a slot 21 and then rotated 90° so that the head extends vertically as shown in FIG. 2 and draws the heating strip 16 against a mounting bushing 28 so as to space the heating strip from the inner surface 24 of the chamber. The pin 22 extends through an opening in the wall 23 and its outer end has a nut 29 thereon which is threaded against a washer or bushing 30 having a projecting portion 31 which is recessed within the outer shell 25 and a portion of the insulating wall. A cap 32 is secured to the bushing by means of bolts 33 and encloses the nut 29.

The carbon which precipitates in the porous fire brick insulation material of the chamber wall 23 during a typical carburizing heat treatment will form a highly conductive layer 34 as indicated schematically in FIG. 4. If there is not a long enough "burnout," this layer 34 will become highly conductive and may cause deterioration of supporting pins and terminals which pass therethrough. In order to protect the supporting pin 22, a sleeve 35 of a dense non-porous refractory material, 0.5% to 5% porosity, encloses the pin 22 as it passes through the wall. This sleeve electrically insulates the terminal or support rod 22 from the porous insulating refractory material which, as mentioned, may become highly conductive along the layer 34 as shown in FIG. 4.

While the rod 22, as illustrated in FIG. 4, has been shown as a support rod or mounting pin for a resistance strip, the refractory sleeve 35 can also be applied to the rod 22 when it is a terminal passing through the wall and secured to the strip.

The presence of the refractory sleeve will prevent adverse effects upon terminals or support rods passing through the wall which might be caused by carbon which may precipitate in the insulation as a result of carburizing heat treatments upon materials within the chamber, the carbon forming an electrically conductive path between the various pins.

It should be apparent that variations may be made in construction and arrangement of parts without departing from the spirit of the invention except as defined in the appended claims.

What is claimed is:

1. In an electric heating furnace for heat treatment having a body with side walls of porous insulating material defining a chamber therein to receive material for heat treatment, the improvement comprising a conductive electric heating resistance strip within said chamber adjacent to the inner hot face of a side wall of porous insulating material for electrically heating said chamber, a plurality of pins each extending through said side wall and being connected to said resistance strip, said porous insulating material of said side wall being subject to the build up of an electrically conductive layer of carbon within the interior thereof spaced inwardly from said hot face if insufficient "burnout" is used, and a plurality of sleeves of dense non-porous refractory material, said sleeves being located in said side wall and surrounding the portions of the respective pins within said porous insulating material of said side wall for electrically insulating each pin from such electrically conductive layer of carbon for preventing the rapid deterioration of the pins which would otherwise be caused by electricity passing through said conductive layer of carbon forming an electrically conductive path.

2. In an electric heating furnace for heat treatment as claimed in claim 1, the improvement to which at least one of said pins is an electric terminal for said electric heating resistance strip.

3. In an electric heating furnace for heat treatment as claimed in claim 1, the improvement in which said sleeves of dense non-porous refractory material each has a 0.5% to 5% porosity.

4. In an electric heating furnace for heat treatment as claimed in claim 1, the improvement in which said electric heating resistance strip has a plurality of elongated apertures therein and each of said pins has a T-head to be inserted through such an aperture and rotated 90° to be secured therein, a mounting bushing surrounding the portion of each pin adjacent to said heating strip and being located between said strip and said hot face for spacing said heating strip from the hot face, said bushing also engaging the inner end of said sleeve near said hot face, and means for mounting each pin on the outside of the body for drawing the heating strip against said mounting bushing, said mounting means including a second bushing surrounding each pin and engaging the outer end of said sleeve.

5. In an electric heating furnace for heat treatment as claimed in claim 4, the improvement in which said side wall has an outer shell and said second bushing includes a projecting portion recessed within said outer shell, said projecting portion of said bushing engaging the outer end of said sleeve.

* * * * *